US009042593B2

(12) United States Patent
Matsunaga et al.

(10) Patent No.: US 9,042,593 B2
(45) Date of Patent: May 26, 2015

(54) SOUND PLAYBACK DEVICE AND ELECTRONIC DEVICE USING SAME

(71) Applicant: Panasonic Corporation, Osaka (JP)

(72) Inventors: Tomoyuki Matsunaga, Mie (JP); Kazuki Honda, Mie (JP); Kazuyuki Kosuda, Osaka (JP); Shigeru Tomoeda, Mie (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/365,639

(22) PCT Filed: Dec. 19, 2012

(86) PCT No.: PCT/JP2012/008093

§ 371 (c)(1),
(2) Date: Jun. 16, 2014

(87) PCT Pub. No.: WO2013/105184

PCT Pub. Date: Jul. 18, 2013

(65) Prior Publication Data

US 2014/0355811 A1 Dec. 4, 2014

(30) Foreign Application Priority Data

Jan. 10, 2012 (JP) ..... 2012-001762

(51) Int. Cl.

| | |
|---|---|
| ***H04R 1/02*** | (2006.01) |
| ***H04R 1/06*** | (2006.01) |
| *H04R 1/28* | (2006.01) |

(52) U.S. Cl.

CPC ..... *H04R 1/023* (2013.01); *H04R 1/06* (2013.01); *H04R 2499/11* (2013.01); *H04R 2499/15* (2013.01); *H04R 1/025* (2013.01); *H04R 2400/11* (2013.01); *H04R 1/2811* (2013.01)

(58) Field of Classification Search

CPC ..... H04R 1/02; H04R 1/025; H04R 1/026; H04R 9/00; H04R 29/003; H04R 2209/00; H04R 2209/41; H04R 9/025; H04R 9/027

USPC ..... 381/386–389, 394, 396, 398, 400, 412, 381/417–418

See application file for complete search history.

(56) References Cited

U.S. PATENT DOCUMENTS

| | | | | |
|---|---|---|---|---|
| 6,757,403 | B2 * | 6/2004 | Urushibata et al. | 381/418 |
| 7,706,561 | B2 * | 4/2010 | Wilmink et al. | 381/398 |

(Continued)

FOREIGN PATENT DOCUMENTS

| | | |
|---|---|---|
| JP | 2001-352597 | 12/2001 |
| JP | 2003-134586 | 5/2003 |

(Continued)

OTHER PUBLICATIONS

International Search Report of PCT Application No. PCT/JP2012/008093 dated Feb. 5, 2013.

*Primary Examiner* — Suhan Ni
(74) *Attorney, Agent, or Firm* — Panasonic Patent Center

(57) ABSTRACT

A protective portion is provided on a lower surface of a sound reproducing device, and has a protective wall that restrains a deformation of a terminal in a direction different from an elastic deformation direction of the terminal. The terminal includes a restrained portion in which the deformation is restrained with the protective wall. The restrained portion is provided at at least one of a position closer to a base than a feeding portion of the terminal and a position closer to a tip portion of the terminal than the feeding portion. The protective wall extends along the restrained portion. This configuration can suppress a plastic deformation of the terminal even when a force in the direction different from the elastic deformation of the terminal is applied to the terminal.

14 Claims, 20 Drawing Sheets

(56) References Cited

U.S. PATENT DOCUMENTS

| | | | | |
|---|---|---|---|---|
| 8,526,659 | B2 * | 9/2013 | Nageno et al. | 381/418 |
| 2001/0053233 | A1 | 12/2001 | Fukazawa et al. | |
| 2003/0077945 | A1 | 4/2003 | Hashiba | |

FOREIGN PATENT DOCUMENTS

| | | |
|---|---|---|
| JP | 2008-219065 | 9/2008 |
| JP | 2009-082878 | 4/2009 |

* cited by examiner

SOUND PLAYBACK DEVICE AND ELECTRONIC DEVICE USING SAME

CROSS-REFERENCE TO RELATED APPLICATIONS

The present application is a U.S. national stage application of the PCT International Application No. PCT/JP2012/008093.

TECHNICAL FIELD

The present invention relates to a sound reproducing device used for an electronic device, such as a mobile phone.

BACKGROUND ART

A conventional loudspeaker system will be described with reference to FIG. 19. FIG. 19 is a cross-sectional view of the conventional loudspeaker system. As shown in FIG. 19, loudspeaker system 1 includes loudspeaker unit 2, front box 103, back plate 104, and terminal 5.

Loudspeaker system 1 includes loudspeaker unit 2 accommodated in a loudspeaker box composed of front box 103 and back plate 104. Terminal 2*a* of loudspeaker unit 2 is connected to a lead wire of a voice coil (not shown) of loudspeaker unit 2. Terminal 2*a* is connected to terminal 5 with lead wire 6.

In loudspeaker system 1, terminal 5 contacts an external board for feeding to input a desired electric signal to loudspeaker unit 2. Patent Literature 1 is known as a prior art document related to the invention.

CITATION LIST

Patent Literature

Patent Literature 1: Japanese Patent Laid-Open Publication No. 2003-134586

SUMMARY

A sound reproducing device includes a magnetic circuit, a frame, a diaphragm, a voice coil, a terminal, and a protective portion. The magnetic circuit includes a magnet and a yoke and a plate. The terminal is made of a wire spring or a plate spring, and has one end fixed to the frame. The protective portion has a protective wall. The protective wall is provided at a lower surface side of the sound reproducing device, and restrains a deformation of the terminal in a direction different from an elastic deformation direction of the terminal. The restrained portion is provided at a part of the terminal. At least of a part of this restrained portion contacts the protective wall to restrain the deformation of the terminal. The restrained portion is provided at at least one of a position closer to a base than a feeding portion of the terminal and a position closer to a tip portion of the terminal than the feeding portion. The protective wall extends along the restrained portion.

The above configuration can suppress a plastic deformation of the terminal even when a force in the direction different from the elastic deformation of the terminal is applied to the terminal.

DETAIL DESCRIPTION OF PREFERRED EMBODIMENTS

Exemplary Embodiment 1

Figure 1:
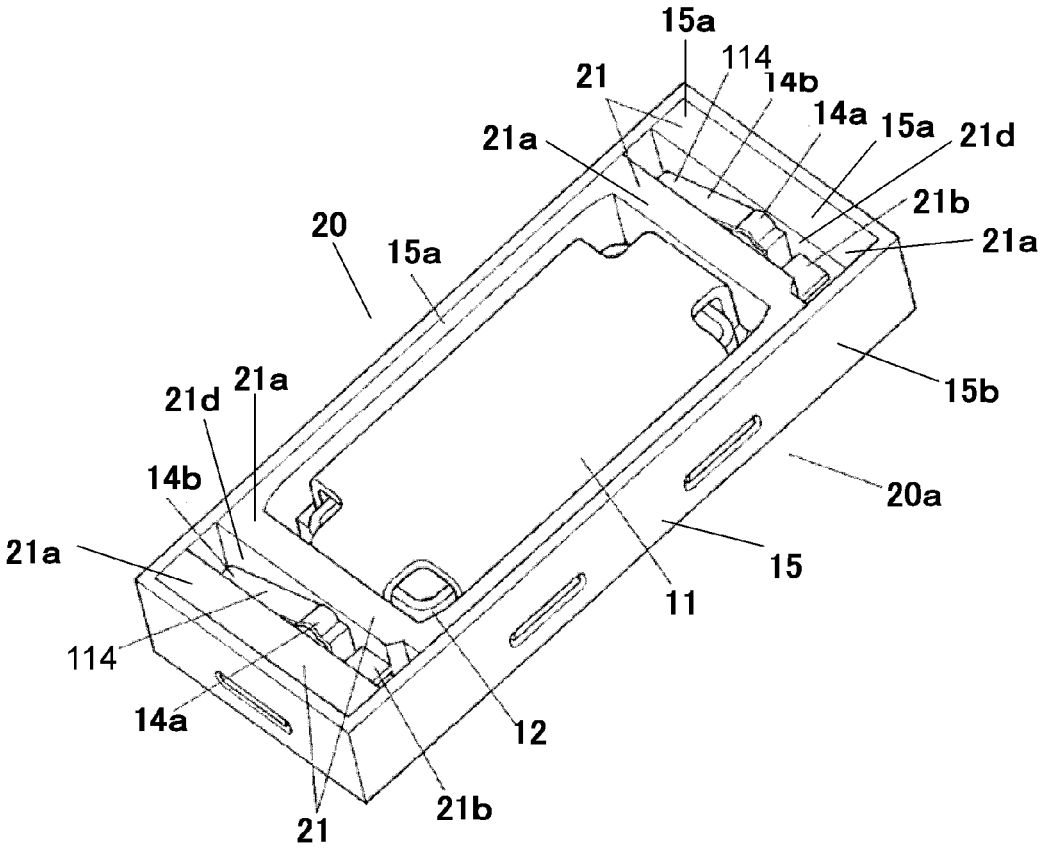
FIG. 1 is a perspective view of a sound reproducing device according to Exemplary Embodiment 1 of the present invention.
Figure 2:
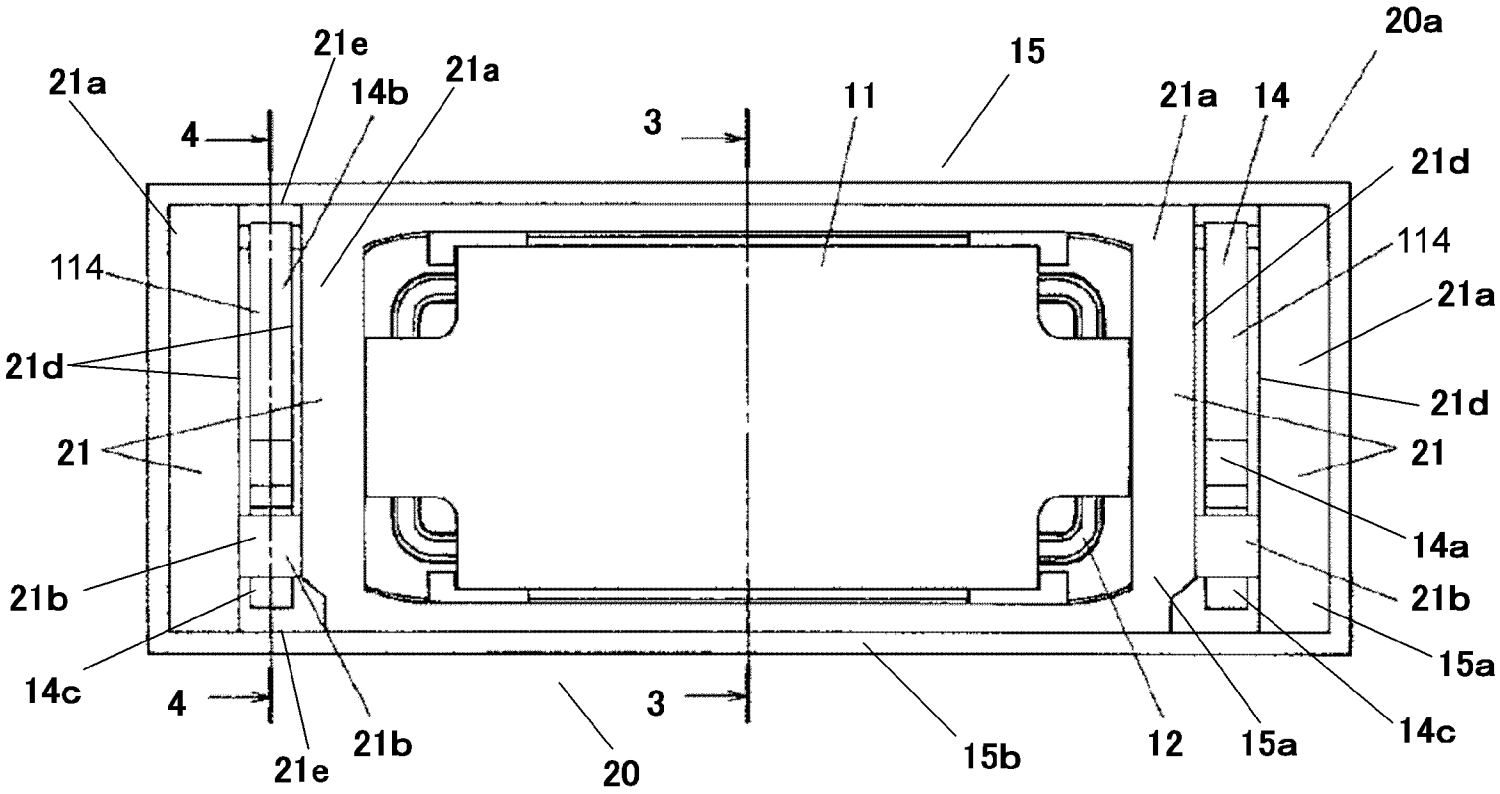
FIG. 2 is a back view of the sound reproducing device according to Embodiment 1.
Figure 3:
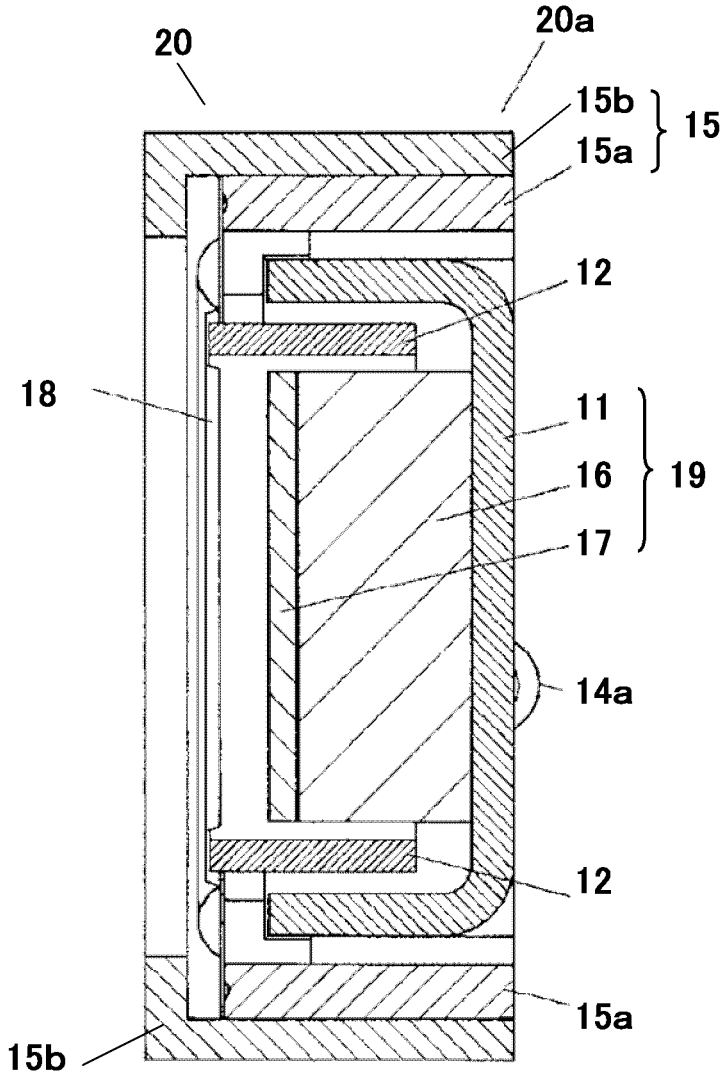
FIG. 3 is a cross-sectional view of the sound reproducing device according to Embodiment 1.
Figure 4:
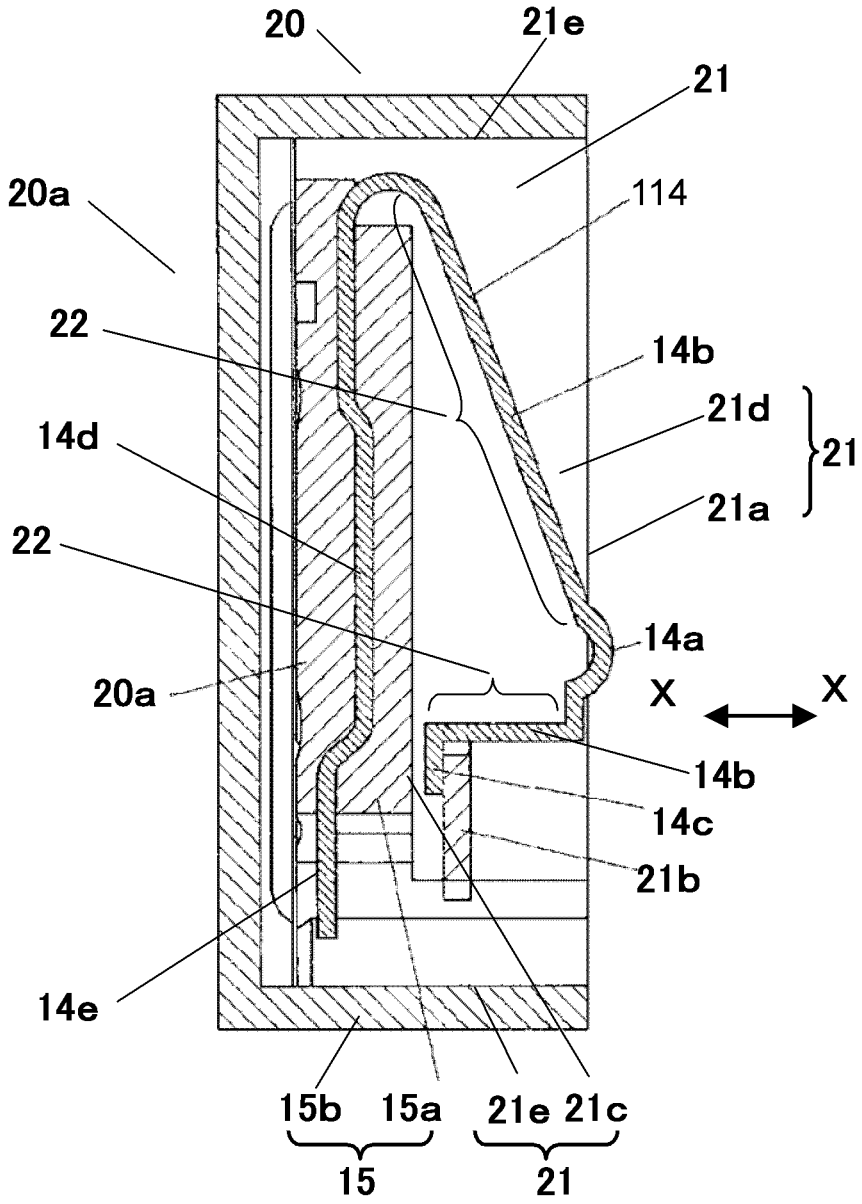
FIG. 4 is a cross-sectional view of the sound reproducing device according to Embodiment 1.

A sound reproducing device according to Exemplary Embodiment 1 will be described with reference to the drawings. FIG. 1 is a perspective view of the sound reproducing device according to Embodiment 1. FIG. 2 is a back view of the sound reproducing device according to Embodiment 1. FIG. 3 is a cross-sectional view of the sound reproducing device according to Embodiment 1. FIG. 3 is a cross-sectional view of the device at line 3-3 shown in FIG. 2. FIG. 4 is a cross-sectional view of the sound reproducing device according to Embodiment 1. FIG. 4 is a cross-sectional view of the device at line 4-4 shown in FIG. 2. In these drawings, the upper side (front side) is a diaphragm 18-side. In these drawings, the lower side (back side) is a side at which feeding portion 14*a* is formed.

Sound reproducing device 20 according to this embodiment includes magnetic circuit 19, frame 15, diaphragm 18, voice coil 12, terminal 114, and protective portion 21. Terminal 114 is made of a wire spring or a plate spring, and has one end fixed to frame 15.

Protective portion 21 is provided at a lower surface-side of sound reproducing device 20, and has protective wall 21*d* that restrains a deformation of terminal 114 in a direction different from an elastic deformation direction of terminal 114 (directions X and X' denoted by arrows shown in FIG. 4). Terminal 114 includes restrained portion 22 having a deformation restrained with protective wall 21*d*. Restrained portion 22 is provided at at least one of a position closer to a base than feeding portion 14*a* of terminal 114 and a position closer to a tip portion of terminal 114 than feeding portion 14*a*. Protective wall 21*d* extends along restrained portion 22.

The above configuration can suppress a plastic deformation of terminal 114 even when a force in a direction different from the elastic deformation of terminal 114 is applied to terminal 114.

Sound reproducing device 20 according to Embodiment 1 will be detailed below. Sound reproducing device 20 according to this embodiment is loudspeaker unit 20*a*. As shown in FIG. 3, magnetic circuit 19 includes magnet 16, yoke 11, and plate 17.

Yoke 11 is coupled to a lower side of the magnet. Yoke 11 is formed unitarily with frame 15 by, e.g. an insert molding. In the case that yoke 11 is insert-molded to frame 15, frame 15 can be produced at a high productivity, and yoke 11 can be coupled to frame 15 with a small amount of adhesive agent. Further, processes coating and drying the adhesive agent are eliminated, thus producing loudspeaker unit 20*a* at a high productivity. This consequently provides cost loudspeaker unit 20*a* with a low cost. The insert molding can provide a higher assembly accuracy of frame 15 and yoke 11 as well as higher reliability of coupled parts, thus providing loudspeaker unit 20*a* with high quality and reliability.

Plate 17 is coupled to an upper side of magnet 16. Voice coil 12 is fixed to diaphragm 18. As shown in FIGS. 1, 2, and 4, terminal 114 is connected to voice coil 12. This allows an external device to feed voice coil 12. Yoke 11 are frame 15 may be separate components, and yoke 11 may be included in frame 15.

Frame 15 according to this embodiment is made of resin. This allows frame 15 to be produced at high productivity even when frame 15 has a complicated shape. Material of frame 15 is not limited to resin. Frame 15 may be made of other materials. For example, frame 15 may be made of metal.

Frame 15 according to this embodiment includes frame 15*a* and frame 15*b*. Frame 15*a* is covered by frame 15*b*. Frame 15*a* is coupled to magnetic circuit 19, and supports diaphragm 18. On the other hand, frame 15*b* has a sound emitting hole in an upper surface thereof, and opens in a lower surface thereof.

Protective portion 21 is provided at a lower surface side of loudspeaker unit 20*a*. Protective portion 21 has protective surface 21*a*, stopper 21*b*, stopper 21*c*, protective wall 21*d*, and protective wall 21*e*. Protective surface 21*a*, stopper 21*b*, stopper 21*c*, and protective wall 21*d* according to this embodiment are formed unitarily with frame 15*a*.

Since frame 15 and protective portion 21 according to this embodiment are made of resin, frame 15 can be easily formed unitarily with protective portion 21 by, e.g. a resin molding. This configuration can reduce the number of components of loudspeaker unit 20*a* at high productivity, thus providing inexpensive loudspeaker unit 20*a*.

On the other hand, protective wall 21*e* according to this embodiment is formed unitarily with frame 15*b*. Protective wall 21*e* may be formed unitarily with frame 15*a*. Frame 15*a* may be formed unitarily with a part of frame 15*b*. Alternatively, instead of being formed unitarily with frame 15*a*, protective portion 21 may be a separate component fixed to frame 15*a*, e.g. with an adhesive agent or by welding.

Terminal 114 includes feeding portion 14*a*, intermediate portions 14*b*, tip portion 14*c*, fixing portion 14*d*, and connection portion 14*e*. Intermediate portions 14*b* according to this embodiment are provided between fixing portion 14*d* and feeding portion 14*a* and between feeding portion 14*a* and tip portion 14*c*. Terminal 114 is bent to have substantially a V-shape. Fixing portion 14*d* is fixed to frame 15*a*. Connection portion 14*e* is exposed from frame 15*a* to be connected to voice coil 12 (shown in FIG. 3). The lead wire of voice coil 12 is connected to connection portion 14*e*. The lead wire may be connected to connection portion 14*e* by, e.g. soldering, welding, or thermo-compression bonding.

Terminal 114 is formed unitarily with frame 15 by insert-molding fixing portion 14*d*. Specifically, terminal 114 is fixed to frame 15*a* such that fixing portion 14*d* of terminal 114 is embedded in frame 15. This configuration allows terminal 114 to elastically deform in up-and-down directions (directions X and X' dented by arrows shown in FIG. 4). Specifically, feeding portion 14*a* can move in the up-and-down directions.

Since terminal 114 is insert-molded to frame 15*a*, frame 15 can be produced at high productivity. This configuration does not require adhesive agent to couple terminal 114 to frame 15*a*. This consequently eliminates processes for coating and drying adhesive agent, thus reducing the number of production processes. Loudspeaker unit 20*a* can be produced at high productivity, thus being inexpensive. Furthermore, the insert molding can assemble frame 15*a* and terminal 114 accurately and with reliability of coupled parts. This consequently can provide loudspeaker unit 20*a* with high quality and reliability.

Terminal 114 according to this embodiment is made of a plate spring. However, terminal 114 is not limited to a plate shape. For example, terminal 114 may have a wire shape. Terminal 114 can be made of any material having any cross-sectional shape appropriately depending on a predetermined elastic force. The cross-sectional shape of terminal 114 is not limited to a rectangular shape, and may be, e.g. a circular shape, an ellipsoidal shape, an oblong shape, a triangular shape, or a trapezoidal shape. Alternatively, in terminal 114, a cross section of a part of intermediate portion 14*b* except for at least a bend part appropriately may have an H-shape or an L-shape.

Protective surface 21*a* is formed on a lower surface of protective portion 21. Feeding portion 14*a* is exposed from protective surface 21*a* so as to allow a set side on which loudspeaker unit 20*a* is mounted to feed loudspeaker unit 20*a*. As a result, even when a worker erroneously applies a force to terminal 114 during the assembly of loudspeaker unit 20*a* to a set, feeding portion 14*a* can be protected from being pressed to a position inner than protective surface 21*a*.

Thus, protective surface 21*a* can restrain the deformation of terminal in an elastic deformation direction of terminal 114. Protective surface 21*a* is formed unitarily with frame 15*a*, hence allowing protective surface 21*a* to have a small positional variation. This stabilizes a dimension between protective surface 21*a* and a tip of feeding portion 14*a*. When loudspeaker unit 20*a* is mounted on a board of the set, a pressure at which feeding portion 14*a* contacts the board of the set is stable.

Terminal 114 includes restrained portion 22. Restrained portion 22 according to this embodiment is provided at a side surface of intermediate portion 14*b* of terminal 114. Upon contacting protective wall 21*d*, restrained portion 22 is prevented by protective wall 21*d* from deforming. Thus, restrained portion 22 may be any part of the terminal so long as the part contacts at least protective wall 21*d*. Entire restrained portion 22 does not necessarily contact protective wall 21*d*. Thus, a part of restrained portion 22 may contact protective wall 21*d*.

Restrained portion 22 may be provided at at least one of a position closer to a base than feeding portion 14*a* of terminal 114 and a position closer to the tip portion of terminal 114 than feeding portion 14*a* of terminal 114. Restrained portion 22 may be provided at one position out of a position close to a base of terminal 114, a position close to feeding portion 14*a*, or a position close to tip portion 14*c*.

Protective walls 21*d* extend along restrained portion 22. Specifically, protective walls 21*d* according to this embodiment face both side surfaces of terminal 114 in a width direction of terminal 114. This configuration allows the side surfaces of terminal 114 to be covered with protective walls 21*d* except for feeding portion 14*a*. Protective walls 21*d* may cover at least any of a potion around the base of terminal 114, around feeding portion 14*a*, or around tip portion 14*c*. An gap between each protective wall 21*d* and the side surface of terminal 114 is determined to prevent terminal 114 from deforming over its elastic limit.

In the case that frame 15*a* and terminal 114 are separate components, the gap between each protective wall 21*d* and the side surface of terminal 114 is determined taking into account of the assembly variation between terminal 114 and frame 15*a*. Specifically, the gap between protective wall 21*d* and the side surface of terminal 114 is determined to prevent terminal 114 from contacting frame 15*a* even if frame 15*a* and terminal 114 are assembled with an assembly variation.

Tip portion 14*c* of terminal 114 extends in a substantially horizontal direction from intermediate portion 14*b*. In a normal state, tip portion 14*c* contacts stopper 21*b* with an elastic force of terminal 114 applying to the stopper. As a result, tip portion 14*c* is engaged with stopper 21*b* and thus is prevented from returning in the back direction. Specifically, upon contacting tip portion 14*c*, stopper 21*b* determines the size of a portion of feeding portion 14*a* which protrudes from protective surface 21*a* in the elastic deformation direction. This configuration can position the back direction (the direction X shown in FIG. 4) in the elastic deformation direction of terminal 114. Stopper 21*b* prevents terminal 114 from warping in the back direction by more than a predetermined amount.

Regarding the elastic deformation of terminal 114, terminal 114 warping towards diaphragm 18 is represented as the warping in the front direction while the warping in the direction opposite to the front direction is represented as the warping in the back direction.

Furthermore, upon contacting tip portion 14*c*, stopper 21*c* prevents terminal 114 from warping in the front direction by more than a predetermined amount. Stopper 21*c* prevents feeding portion 14*a* from being pushed to the inner side by more than a predetermined amount even when a worker trying to assemble loudspeaker unit 20*a* with the set erroneously applies a force to terminal 114. Thus, stopper 21*c* can restrain the deformation of terminal 114 so as not to exceed an elastic limit to the elastic deformation direction of terminal 114. Tip portion 14*c* can be inserted into a gap provided between stopper 21*b* and stopper 21*c* by warping intermediate portion 14*b*.

Protective portion 21 has both side surfaces opening in a direction extending from terminal 114 (the vertical direction in FIG. 2). Thus, Frame 15*b* has a side wall in the direction extending from terminal 114. Specifically, the side wall of frame 15*b* functions as protective wall 21*e*.

Figure 19:
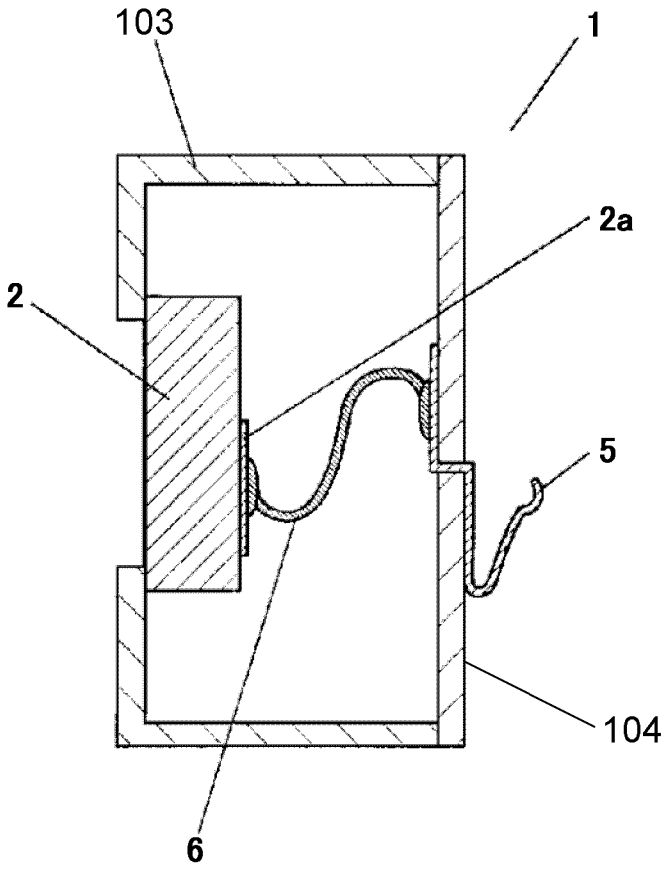
FIG. 19 PRIOR ART
FIG. 19 is a cross-sectional view of a terminal of a conventional loudspeaker unit.

In conventional loudspeaker system 1 shown in FIG. 19, terminal 5 is exposed. Thus, while a worker produces or packs loudspeaker system 1 into a box or installs loudspeaker system 1 into an electronic device, he/she may erroneously contact terminal 5.

This contacting provides a problem that terminal 5 plastically deforms, and reduces a power feeding from the set side or a contact pressure to the set-side board, thus resulting in an unstable contact with the board for example.

To solve the above problem, the device according to this embodiment includes protective walls 21*d* and 21*e* shown in FIGS. 1 to 4. This configuration can retain the position of terminal 114 in a direction different from the elastic deformation direction (a lateral width direction of terminal 114 of the plate spring and a lateral direction in FIG. 2), and suppresses the deformation of terminal 114.

Furthermore, protective surface 21*a* on the back surface of protective portion 21 prevents an excessive force from being applied to terminal 114 when a worker erroneously grabs or touches intermediate portion 14*b*.

Furthermore, tip portion 14*c* contacting stoppers 21*b* and 21*c* can restrain an excessive plastic deformation of terminal 114 in the elastic deformation direction. This configuration stabilizes the size of the portion of feeding portion 14*a* protruding from protective face 21*a*. Protective walls 21*d* provided at both sides of terminal 114 can further suppress the plastic deformation of terminal 114.

The configuration described above prevents an excessive plastic deformation of terminal 114 in the elastic deformation direction of terminal 114, and prevents an excessive plastic deformation of terminal 114 in a direction different from the elastic deformation direction of terminal 114. This can consequently reduce the defective deformation of terminal 114.

In conventional loudspeaker system 1 shown in FIG. 19, terminal 2*a* is connected to terminal 5 with lead wire 6. Thus, a process for connecting lead wire 6 to terminals 2*a* and 5 is required. Lead wire 6 is connected by, e.g. soldering.

Loudspeaker unit 20*a* shown in FIGS. 1 to 4 can reduce the number of constituting components, such as lead wire 6 (shown in FIG. 19), and can eliminate the process for soldering lead wire 6. This can consequently provide inexpensive loudspeaker unit 20*a*.

Loudspeaker unit 20*a* as described above is installed in an electronic device, such as a mobile device typically including a mobile phone. Since terminal 114 can have the stable protrusion size, feeding portion 14*a* can contact a feeding portion of the electronic device with an appropriate force. Thus, loudspeaker unit 20*a* can stably receive a power, thus providing an electronic device with high quality and reliability. A mobile device is particularly involved with a possibility of the deformation of terminal 114 due to falling for example. To prevent this, the configuration as described above can provide a remarkable effect providing power feeding even when, e.g. a falling impact is applied.

In loudspeaker unit 20*a* shown in FIGS. 1 to 4, a loudspeaker box may be provided at the back surface side. In this case, the loudspeaker box is attached so as to cover the back surface of loudspeaker unit 20*a*. This configuration can suppress a sound leakage from the back surface. The loudspeaker box has a through-hole formed at positions corresponding to feeding portions 14*a*.

Protective walls 21*d* and 21*e* according to this embodiment have flat surfaces. However, protective walls 21*d* and 21*e* may have, e.g. curved surfaces or cylindrical shapes. Protective walls 21*d* facing each other are not necessarily parallel to each other. For example, the interval between protective walls 21*d* facing each other may increase from the base of terminal 114 toward tip portion 14*c*. Alternatively, the opposite configuration may be used in which the interval between protective walls 21*d* facing each other decreases from the base of terminal 114 toward tip portion 14*c*.

Loudspeaker unit 20*a* may not necessarily have a rectangular shape. Thus, the present invention can use any shape, such as a circular shape or an ellipsoidal shape, with the same effect as the rectangular shape.

Exemplary Embodiment 2

Sound reproducing device 20 according to Exemplary Embodiment 2 will be described below. Sound reproducing device 20 according to this embodiment is loudspeaker system 30. Loudspeaker system 30 according to this embodiment will be described with reference to drawings.

Figure 5:
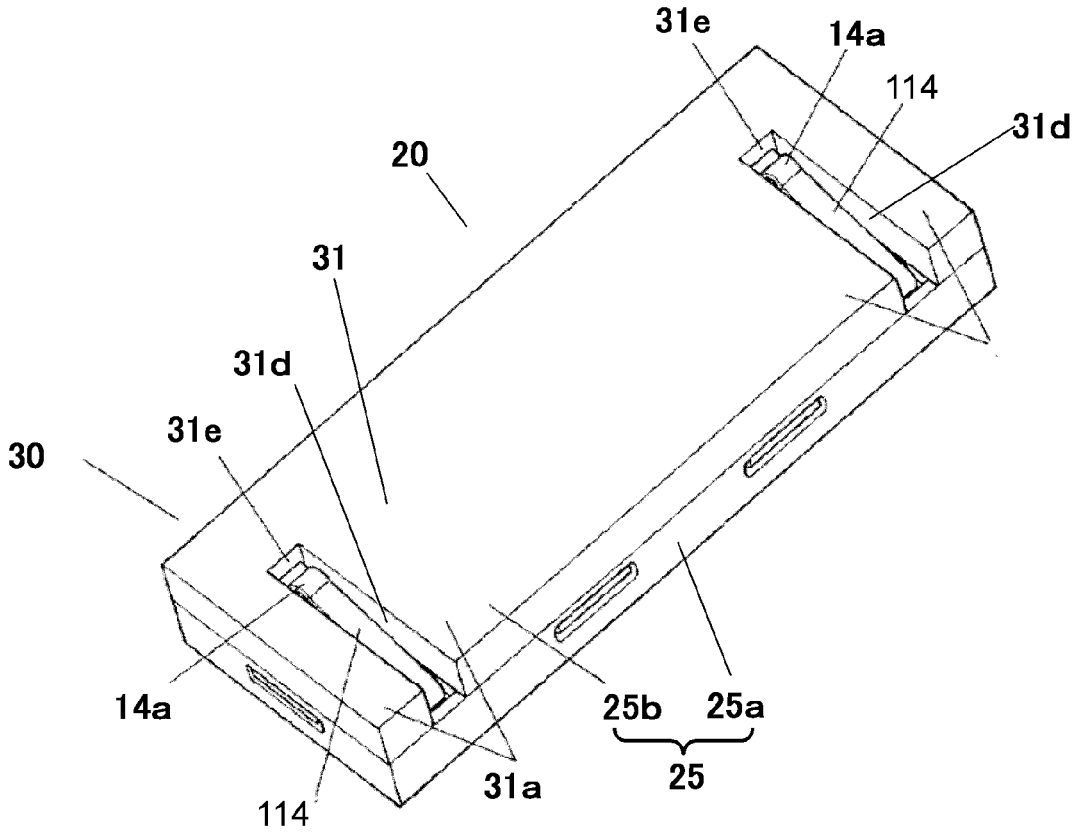
FIG. 5 is a perspective view of a first example of a sound reproducing device according to Exemplary Embodiment 2 of the present invention.
Figure 6:
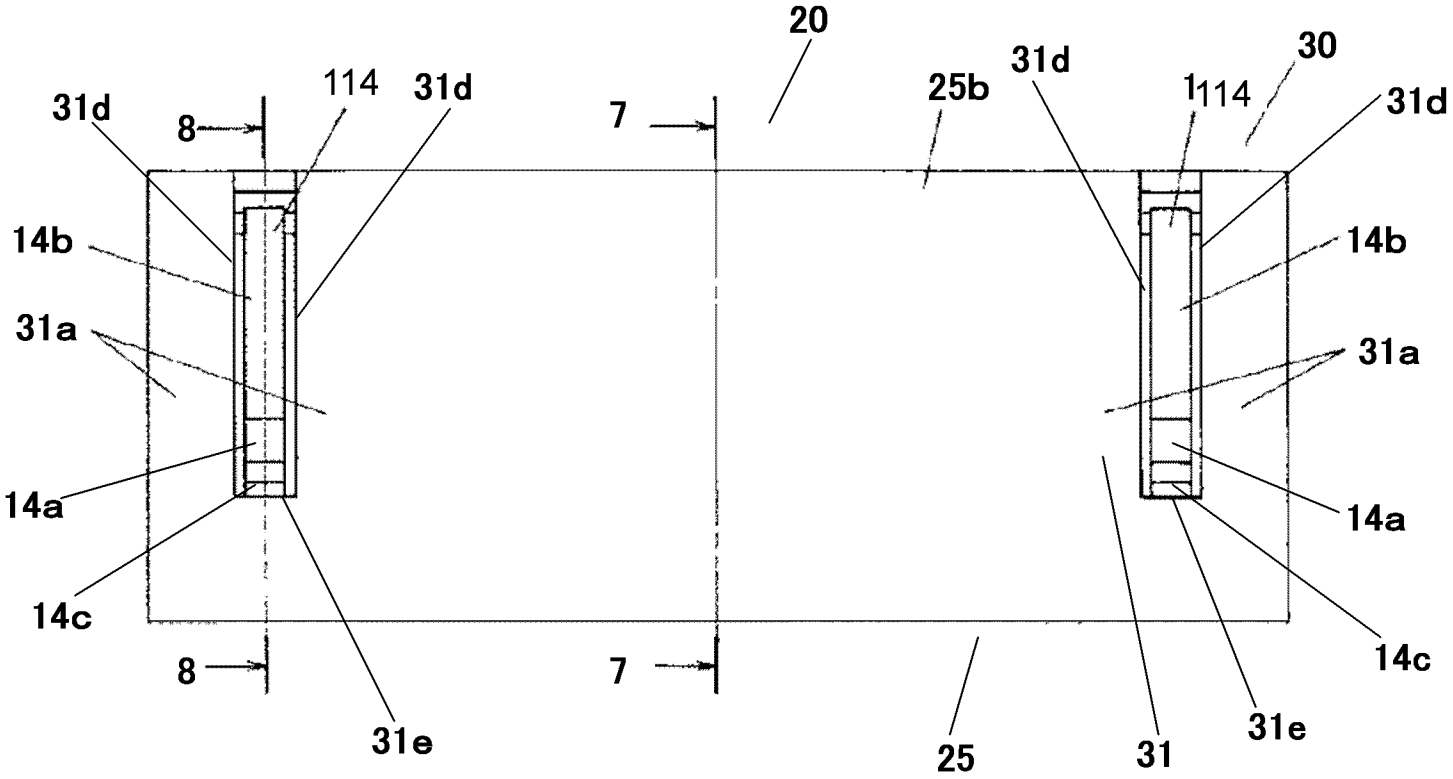
FIG. 6 is a back view of the first example of the sound reproducing device according to Embodiment 2.
Figure 7:
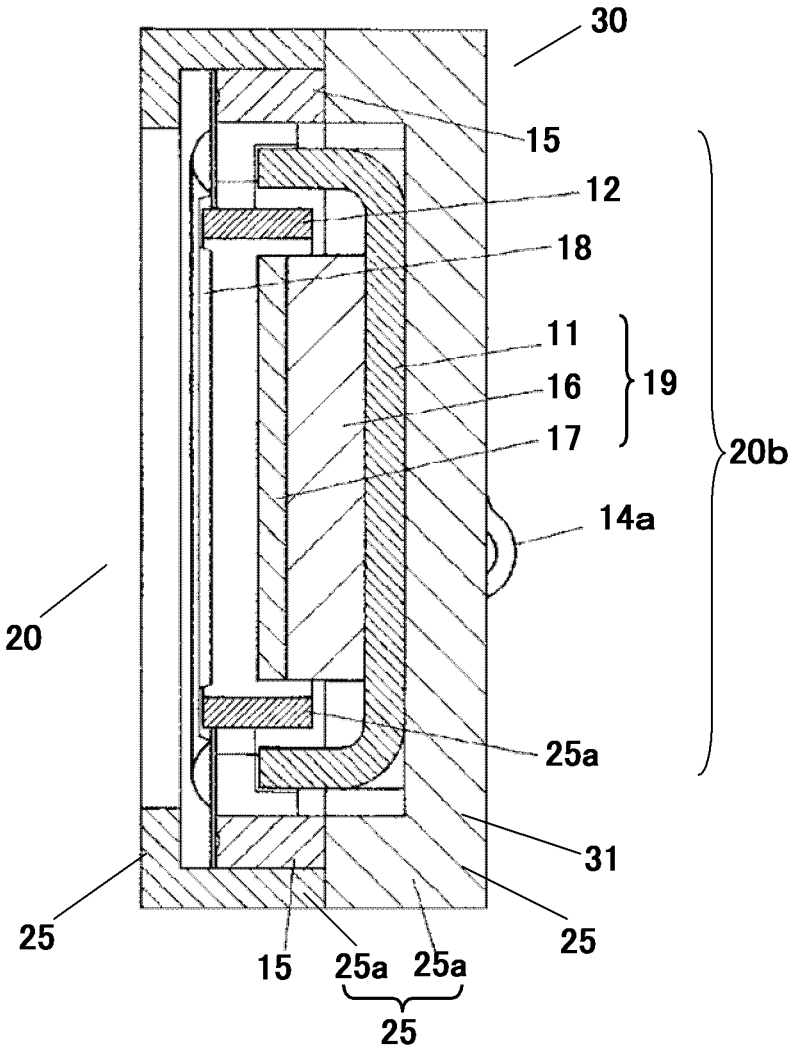
FIG. 7 is a cross-sectional view of the first example of the sound reproducing device according to Embodiment 2.
Figure 8:
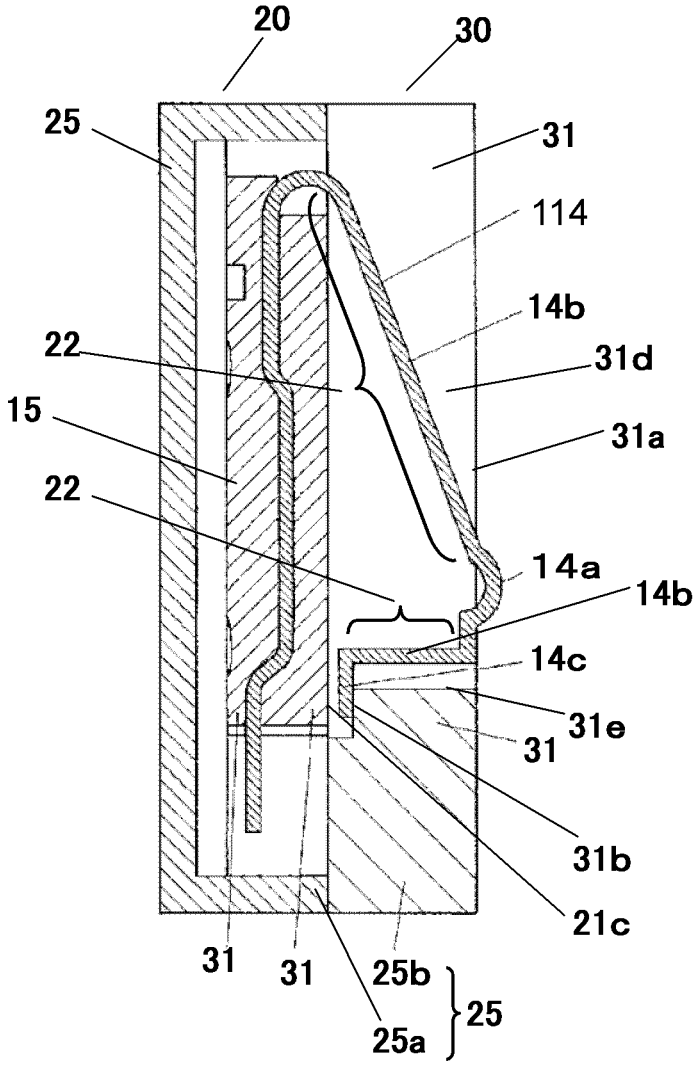
FIG. 8 is a cross-sectional view of the first example of the sound reproducing device according to Embodiment 2.

FIG. 5 is a perspective view of the sound reproducing device according to Embodiment 2. FIG. 6 is a back view of the sound reproducing device according to Embodiment 2. FIG. 7 is a cross-sectional view of the sound reproducing device according to Embodiment 2. FIG. 7 shows a cross section at line 7-7 shown in FIG. 6. FIG. 8 is a cross-sectional view of the sound reproducing device according to Embodiment 2. FIG. 8 shows a cross section at line 8-8 shown in FIG. 6.

As shown in FIG. 5 to FIG. 8, loudspeaker system 30 is configured such that loudspeaker box 25 accommodates loudspeaker unit 20*b* therein. Loudspeaker box 25 includes front panel 25*a* and back panel 25*b*. Front panel 25*a* functions as frame 15*a* (shown in FIG. 1) according to Embodiment 1. Specifically, front panel 25*a* is provided at the front surface of loudspeaker unit 20*b* so as to cover the front surface of loudspeaker unit 20*b*. The center of front panel 25*a* has a sound hole through which sound emitted from diaphragm 18 passes. Front panel 25*a* may include a part of frame 15. On the contrary, frame 15 may include a part of front panel 25*a*.

On the other hand, back panel 25*b* is provided at the back surface of loudspeaker unit 20*b* to cover the back surface of loudspeaker unit 20*b*.

Apart at which front panel 25*a* is connected to back panel 25*b* is sealed. The sealing can be provided by, e.g. adhesive agent, sealing agent, or a double-sided tape. The configuration as described above can suppress the air leakage from the part at which front panel 25*a* is connected to back panel 25*b*.

Alternatively, the part at which front panel 25*a* is connected to back panel 25*b* may be sealed by, e.g. ultrasound welding. The ultrasound welding can reduce a process for connecting front panel 25*a* to back panel 25*b*, thus producing loudspeaker system 30 at high productivity. The ultrasound welding also can eliminate the need for adhesive agent, sealing agent, or a double-sided tape, thus reducing the number of constituting components of the system, thus providing inexpensive loudspeaker system 30.

The sealing can suppress an influence on the set-side housing structure for mounting loudspeaker system 30 or a sound pressure frequency characteristic of loudspeaker system 30 caused by its shape.

Loudspeaker unit 20*b* used for loudspeaker system 30 is different from loudspeaker unit 20*a* (shown in FIG. 1) according to Embodiment 1 in the following configuration. Specifically, the frame of loudspeaker unit 20*b* does not include protective portion 31 except for stopper 21*c*.

On the other hand, back panel 25*b* has protective portion 31 except for stopper 21*c*. Specifically, back panel 25*b* includes protective surface 31*a*, stopper 31*b*, protective wall 31*d*, and protective wall 31*e*. The bottom surface of back panel 25*b* constitutes protective surface 31*a*. Loudspeaker system 30 is configured such that feeding portion 14*a* is exposed from protective surface 31*a* of back panel 25*b* in order to receive the power feeding from the set side.

Stopper 31*b* faces tip portion 14*c*. Back panel 25*b* is joined to front panel 25*a* so that stopper 31*b* pushes tip portion 14*c* in the front direction. Thus, when front panel 25*a* is coupled to back panel 25*b*, tip portion 14*c* contacts stopper 31*c*, thus providing high productivity.

This configuration provides terminal 114 with an elastic force in a direction returning to the back direction. Thus, stopper 31*b* determines the position of terminal 114 in the elastic deformation direction to the back direction. This consequently stabilizes the size of a portion of feeding portion 14*a* protruding from protective face 31*a*.

Stopper 21*c* faces tip portion 14*c*. Thus, when terminal 114 receives a force in a direction in which terminal 114 deforms in the front direction, tip portion 14*c* contacts stopper 21*c*. Stopper 21*c* prevents terminal 114 from elastically deforming to exceed an elastic limit in the direction along which terminal 114 is elastically deformed. As a result, stopper 21*c* can prevent the plastic deformation of terminal 114 to the front direction.

Furthermore, protective wall 31*d* can restrain the deformation in a direction different from the elastic deformation direction of terminal 114 (a lateral width direction of terminal 114 and a lateral direction shown in FIG. 6). Thus, protective wall 31*d* corresponds to restrained portion 22 of terminal 114. Protective walls 31*d* according to this embodiment face both side surfaces of terminal 114 in the width direction and to cover intermediate portion 14*b*. This configuration can further restrain the deformation of terminal 114 in a direction different from the elastic deformation direction of terminal 114.

Protective wall 31*e* according to this embodiment faces the outer surface of intermediate portion 14*b* between feeding portion 14*a* and tip portion 14*c*. This configuration can prevent a worker from touching intermediate portion 14*b* between feeding portion 14*a* and tip portion 14*c*. Thus, a plastic deformation of terminal 114 in the direction different from the elastic deformation direction of terminal 114 can be suppressed.

Terminal 114 according to this embodiment is surrounded in three directions except for the elastic deformation direction by protective walls 31*d* and 31*e*. This configuration can further restrain the plastic deformation of terminal 114 in the direction different from the elastic deformation direction of terminal 114. This maintains a pressure to contact the set-side circuit board.

As described above, protective portion 31 of back panel 25*b* allows terminal 114 to be held by back panel 25*b*. This configuration can eliminate another stopper, thus reducing the number of components and providing inexpensive loudspeaker system 30.

Furthermore, when another stopper is fixed to the back panel, a variation is caused in the size accuracy of the stopper itself or in the assembly accuracy of the stopper, thus increasing variation of the size of the protruding portion of feeding portion 14*a*.

Since stopper 31*b* is formed unitarily with back panel 25*b*, stopper 31*b* can be positioned accurately. Thus, feeding portion 14*a* can have a small variation in the protrusion size, thus stabilizing the contact pressure between the board and the set.

Furthermore, lead wire 6 of conventional loudspeaker system 1 shown in FIG. 19 is eliminated, thus reducing the number of constituting components. Furthermore, since the soldering is lead wire 6 not required, no soldering process is needed. Therefore, inexpensive loudspeaker system 30 can be provided. Furthermore, since such an internal wiring is not required, a space for the internal wiring is not required. This can consequently provide loudspeaker system 30 having a smaller size and thickness. Thus, sound reproducing device 20 according to this embodiment can reduce the size of a mobile electronic device, such as a mobile phone, thus providing a mobile device with high portability.

A housing of an electronic device has a certain level of ventilation. Thus, when conventional loudspeaker unit 2 (shown in FIG. 19) is directly installed to such an electronic device, sound emitted to the front side of loudspeaker unit 2 is mixed with sound emitted to the back surface of loudspeaker unit 2. The sound emitted to the back surface of loudspeaker unit 2 includes sound having a phase reverse to that of the sound emitted to the front side of loudspeaker unit 2. Thus, the sound emitted to the front of loudspeaker unit 2 mixed with the sound emitted to the back surface of loudspeaker unit 2 may cancel the sound emitted to the front of loudspeaker unit 2 with the sound emitted to the back surface of loudspeaker unit 2. As a result, loudspeaker unit 2 does not obtain a desired sound pressure frequency characteristic.

In view of the above, loudspeaker system 30 according to this embodiment is configured such that loudspeaker box 25 accommodates loudspeaker unit 20*b* therein. This configuration can suppress the sound emitted to the front surface of the diaphragm from being mixed with the sound emitted to the back surface of the diaphragm. As a result, even small loudspeaker unit 20*b* can be used to obtain loudspeaker system 30 having a desired sound pressure level or reproducing bandwidth. Thus, when loudspeaker system 30 is used for a mobile electronic device (e.g., mobile phone) which is required to have a small size, such an electronic device can be realized that can reproduce high-quality sound while having a small size.

Furthermore, loudspeaker box 25 blocks air leakage from outside air to provide high airtightness. Even when the housing of the electronic device has ventilation ability, this configuration prevents the sound emitted to the front surface of the diaphragm from being cancelled by the sound emitted from the back surface of the diaphragm. Thus, the electronic device can secure a desired sound pressure frequency characteristic.

To realize this, a cushion or inserted adhesive agent or sealing agent may be provided between the inner surface of loudspeaker box 25 and loudspeaker unit 20*b*. This configuration can suppress the air leakage from loudspeaker box 25.

Loudspeaker unit 20*b* and loudspeaker box 25 may have other shapes, such as a circular shape or a polygonal shape, other than a rectangular shape. Alternatively, loudspeaker unit 20*b* may have a different shape from loudspeaker box 25. For example, loudspeaker unit 20*b* may have a circular shape and loudspeaker box 25 may have a rectangular shape. On the contrary, loudspeaker unit 20*b* may have a rectangular shape and loudspeaker box 25 may have a circular shape.

Figure 9:
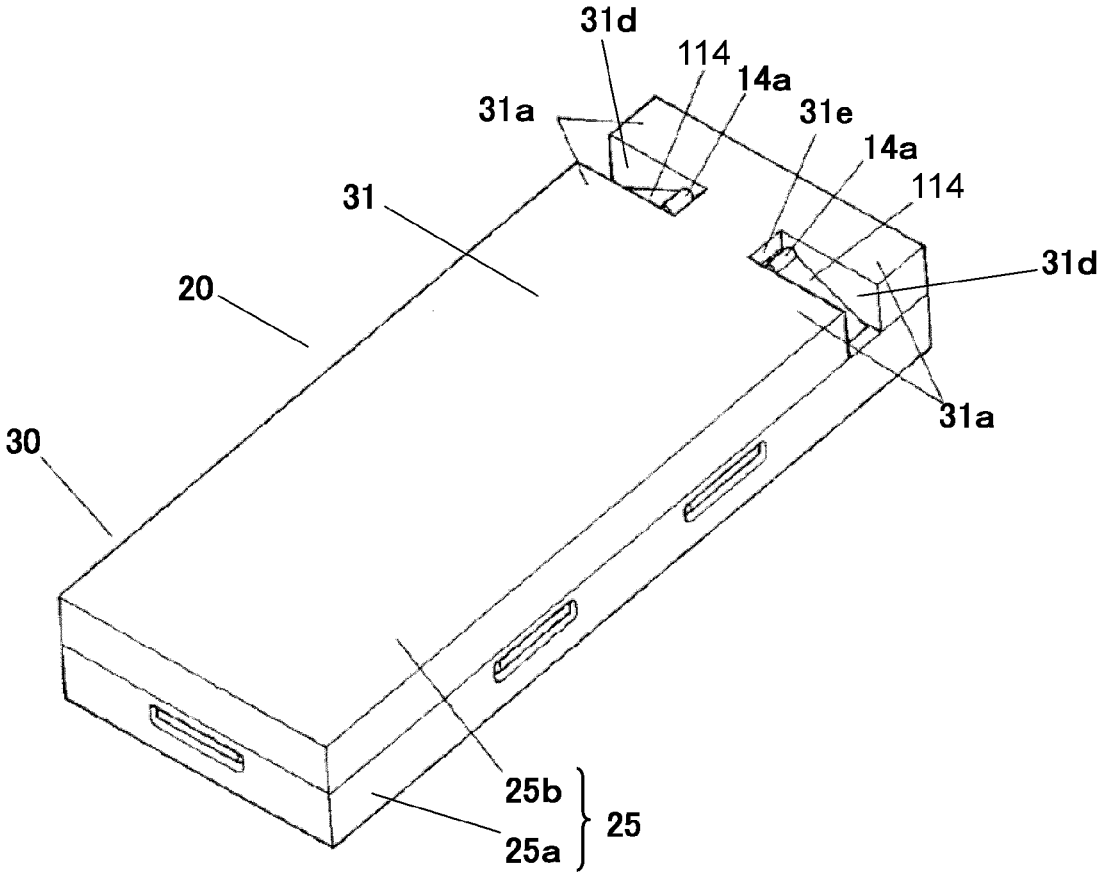
FIG. 9 is a perspective view of a second example of the sound reproducing device according to Embodiment 2.

FIG. 9 is a perspective view a second example of the loudspeaker system according to this embodiment.

As shown in FIG. 9, loudspeaker system 30 of this example is configured such that terminals 114 are arranged only at one end of loudspeaker system 30. In this case, terminals 114 may be arranged such that that tip portions 14*c* inwardly faces each other. This configuration allows protective wall 31*e* to face intermediate portion 14*b* between feeding portion 14*a* of terminal 114 and tip portion 14*c*. Thus, since intermediate portion 14*b* between feeding portion 14*a* of terminal 114 and tip portion 14*c* is covered by protective wall 31*e*, a worker can be prevented from touching intermediate portion 14*b* between feeding portion 14*a* of terminal 114 and tip portion 14*c*.

Figure 10:
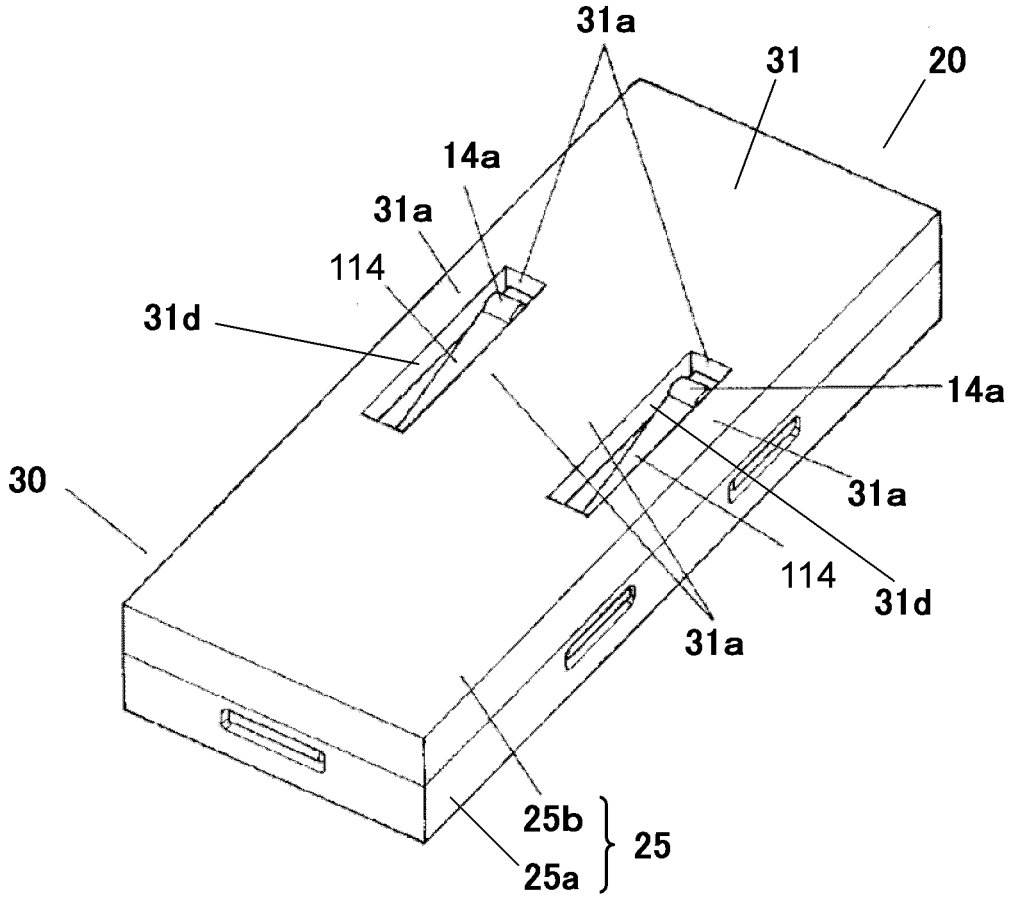
FIG. 10 is a perspective view of a third example of the sound reproducing device according to Embodiment 2.

FIG. 10 is a perspective view of a third example of the loudspeaker system according to this embodiment. As shown in FIG. 10, loudspeaker system 30 of this example is configured such that terminal 114 is provided in the vicinity of the center of loudspeaker box 25. In this case, terminal 114 is surrounded by protective walls 31*d* and 31*e* in four directions except for the elastic deformation direction of terminal 114. Thus, a worker can be prevented from touching intermediate portion 14*b* provided between feeding portion 14*a* of terminal 114 and tip portion 14*c* or between feeding portion 14*a* and fixing portion 14*d* of terminal 114.

According to this embodiment, protective walls 31*d* and 31*e* for preventing the deformation of terminal 114 are provided in three or four directions. However, any structure can be used that suppresses the deformation in a direction different from the elastic deformation direction of terminal 114. Thus, protective walls 31*d* and 31*e* may be provided in one direction or two directions out of directions other than the elastic deformation direction of the terminal.

Protective walls 31*d* may not necessarily be parallel to each other. For example, the interval between protective walls 21*d* facing each other may increase from the base of terminal 114 toward tip portion 14*c*. Alternatively, the interval between protective walls 21*d* facing each other may decrease from the base of terminal 114 toward tip portion 14*c*. Protective walls 31*d* and 31*e* have a flat surface, but may have a curved surface or a cylindrical shape.

Loudspeaker unit 20*b* and loudspeaker system 30 may not necessarily have a rectangular shape. Thus, the present invention can be applied to, e.g. a circular or ellipsoidal shape with the same effect.

Furthermore, protective wall 31*e* may surround feeding portion 14*a*. This configuration allows protective face 31*a* to cover terminal 114 except for feeding portion 14*a*. Thus, a worker can be prevented from erroneously touching intermediate portion 14*b* of terminal 114.

Figure 11:
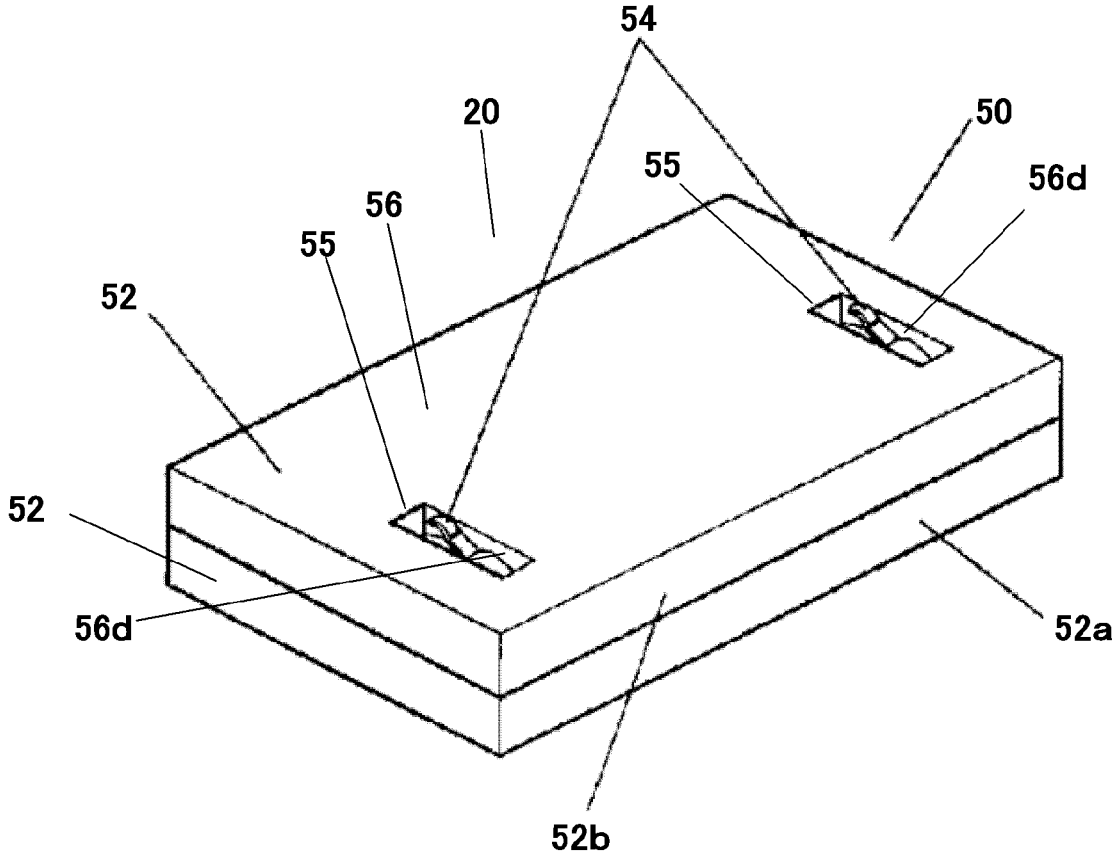
FIG. 11 is a perspective view of a fourth example of the sound reproducing device according to Embodiment 2.
Figure 12:
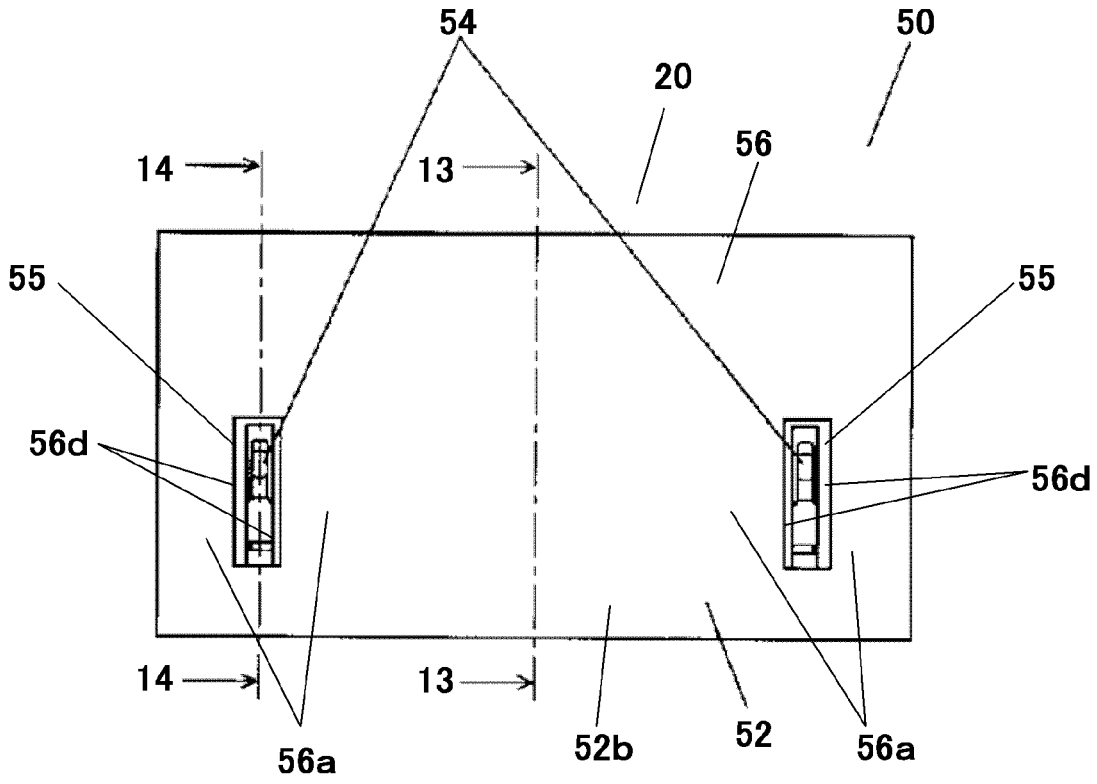
FIG. 12 is a back view of the fourth example of the sound reproducing device according to Embodiment 2.
Figure 13:
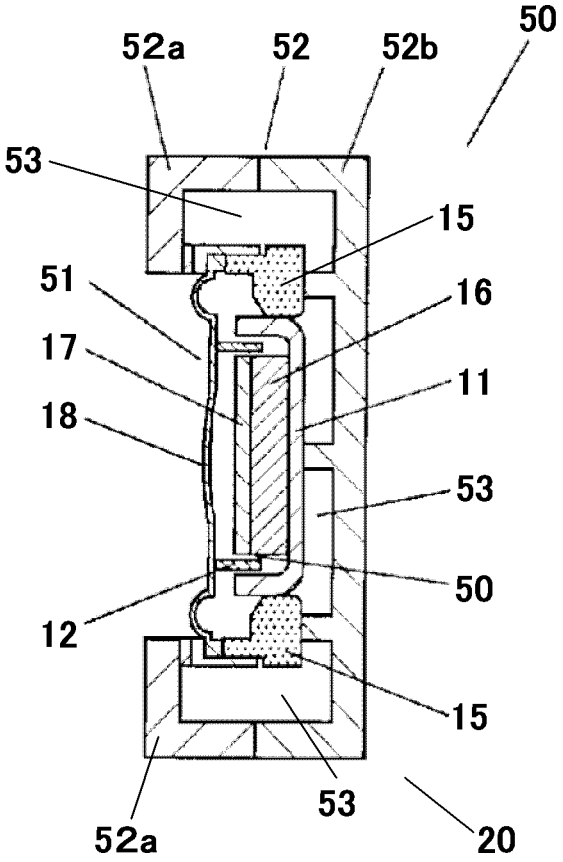
FIG. 13 is a cross-sectional of the fourth example of the sound reproducing device according to Embodiment 2.
Figure 14:
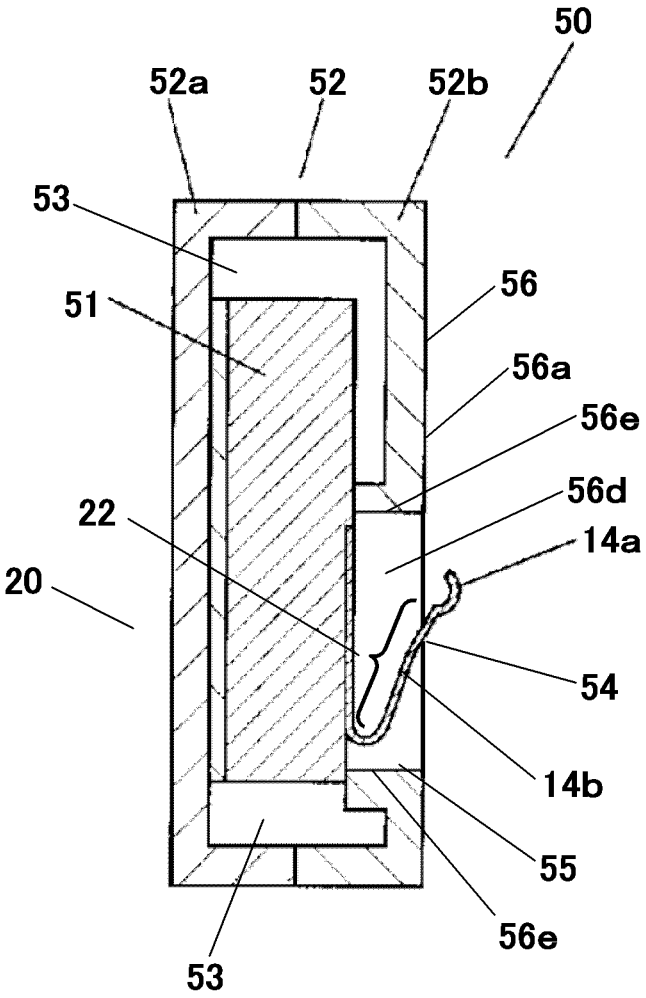
FIG. 14 is a cross-sectional view of the fourth example of the sound reproducing device according to Embodiment 2.

A fourth example of the loudspeaker system according to this embodiment will be described. FIG. 11 is a perspective view of the fourth example of the loudspeaker system according to this embodiment. FIG. 12 is a back view of the fourth example of the loudspeaker system according to this embodiment. FIG. 13 is a cross-sectional view of the fourth example of the loudspeaker system according to this embodiment. FIG. 13 shows a cross section at line 13-13 shown in FIG. 12. FIG. 14 is a cross-sectional view of the loudspeaker system according to this embodiment. FIG. 14 illustrates a cross section at line 14-14 shown in FIG. 12. In FIGS. 11 to 14, components identical to those shown in FIGS. 1 to 6 and 7 to 10 are denoted by the same reference numerals, and will be described briefly.

As shown in FIGS. 11 and 14, loudspeaker system 50 of this example is configured such that loudspeaker unit 51 is accommodated in loudspeaker box 52. Loudspeaker system 50 is configured such that space 53 is provided between loudspeaker unit 51 and loudspeaker box 52.

Terminal 54 of loudspeaker unit 51 is configured such that intermediate portion 14*b* is provided between feeding portion 14*a* and fixing portion 14*d*.

Loudspeaker box 52 includes front panel 52*a* and back panel 52*b*. The center of front panel 52*a* has a tone hole through which sound emitted from diaphragm 18 passes. On the other hand, back panel 52*b* includes two through-holes 55. Terminals 54 are inserted in the respective through-holes 55.

As shown in FIG. 14, back panel 52*b* has protective portion 56. Protective portion 56 of this example includes protective surface 56*a*, stopper 56*b*, protective wall 56*d*, and protective wall 56*e*. Protective surface 56*a* of this example is constituted by the outer surface of the bottom section of back panel 52*b*. Protective wall 56*d* and protective wall 56*e* functions as a side surface of through-hole 55.

As a result, terminal 54 penetrates through through-hole 55 and has feeding portion 14*a* protruding from protective surface 56*a*. Thus, the elastic force of terminal 54 causes terminal 54 to contact the set-side board to which loudspeaker system 50 is mounted. As a result, loudspeaker system 50 can be fed from the set side via feeding portion 14*a*.

In the above-described configuration, protective wall 56*d* and protective wall 56*e* covers restrained portion 22. As a result, terminal 54 is prevented from deforming in directions other than the elastic deformation direction, thus suppressing the plastic deformation of terminal 54. Furthermore, protective surface 56*a* formed at the back surface side of protective portion 56 can prevent a worker from erroneously grabbing or touching terminal 54 for example.

Protective wall 56*d* and protective wall 56*e* according to this embodiment surround terminal 114 in the four directions except for the elastic deformation direction of terminal 54. Thus, the plastic deformation of terminal 54 can be further suppressed.

The configuration as described above can prevent terminal 54 from having an excessive plastic deformation in the elastic deformation direction, and from deforming in a direction different from the elastic deformation direction of terminal 54. This can consequently reduce deformation defects of terminal 54.

As shown in FIG. 14, the inner surface of front panel 52*a* is coupled to the front surface of loudspeaker unit 51 while being pushed on the front surface of loudspeaker unit 51. This configuration can prevent air in space 53 from leaking from the front surface of loudspeaker unit 51. Thus, the inner surface of front panel 52*a* may be coupled to loudspeaker unit 51 by a cushion, adhesive agent or sealing agent. The inner surface of front panel 52*a* may have a projection pushed onto the front surface of loudspeaker unit 51.

Furthermore, loudspeaker box 52 may be required to prevent air leakage from back panel 52*b*. To address this, as shown in FIG. 12, the area of through-hole 55 is as small possible. A small gap may be provided between protective wall 56*d* and frame 15, and a small gap may be provided between edges of protective wall 56*e* and frame 15. Alternatively, the edges of protective wall 56*d* and protective wall 56*e* may contact the back surface of frame 15. Alternatively, a part between frame 15 and each of the edges of protective wall 56*d* and protective wall 56*e* may be sealed. This configuration can suppress air leakage from loudspeaker box 52. For example, the sealing can be performed by appropriately inserting a cushion, adhesive agent, sealing agent, or double-sided tape between frame 15 and each of the edges of protective wall 56*d* and protective wall 56*e*.

The inner surface of loudspeaker box 52 contacting loudspeaker unit 51 may have an undulation. This configuration can further suppress the air in space 53 from leaking to the outside of loudspeaker box 52. In this case, the air in space 53 can be further suppressed from leaking by providing cushion, adhesive agent, or sealing agent for example between the undulation of the inner surface of loudspeaker box 52 and loudspeaker unit 51.

A part at which front panel 52*a* is connected to back panel 52*b* may be sealed. For example, the sealing can be performed with, e.g. a cushion, adhesive agent, double-sided tape, or sealing agent. This can suppress the air in space 53 from leaking to the outside of loudspeaker box 52. Furthermore, one of parts of front panel 52*a* and back panel 52*b* connected to each other may have a recess therein and the other side may have a protrusion. By engaging the protrusion into the recess, the air in space 53 can be suppressed from leaking to the outside of loudspeaker box 52. In this case, a cushion, adhesive agent, or sealing agent for example may be provided at the parts of front panel 52*a* and back panel 52*b* connected to each other, the air in space 53 can be further prevented from leaking to the outside of loudspeaker box 52.

Furthermore, the sealing between front panel 52*a* and back panel 52*b* as well as the sealing between protective wall 56*d* and protective wall 56*e* and frame 15 may be performed by a method, such as ultrasound welding. In this case, a process for coating adhesive agent or a process from drying it is not required, thus reducing the number of processes, thus providing loudspeaker system 50 with high productivity. In addition, the elimination of the sealing or the adhesion members can reduce the cost of constituting components.

The configuration as described above secures the airtightness in loudspeaker box 52. Thus, a desired sound pressure frequency characteristic can be secured while providing the device with a small size. In particular, space 53 can reproduce a sound at low frequencies.

Loudspeaker system 50 may be configured such that loudspeaker unit 51 is substituted with loudspeaker unit 20*a* according to Embodiment 1 shown in FIG. 1. In this case, feeding portion 14*a* of loudspeaker unit 20*a* shown in FIG. 1 is configured such that, when back panel 52*b* is attached to loudspeaker unit 20*a*, feeding portion 14*a* is exposed from protective surface 56*a*. Since loudspeaker unit 20*a* has protective portion 21, the plastic deformation of terminal 114 can be suppressed even when back panel 52*b* does not have protective portion 56. In this case, through-hole 55 can have a large area, thus allowing loudspeaker unit 20*a* to be easily installed in loudspeaker box 52.

Figure 15:
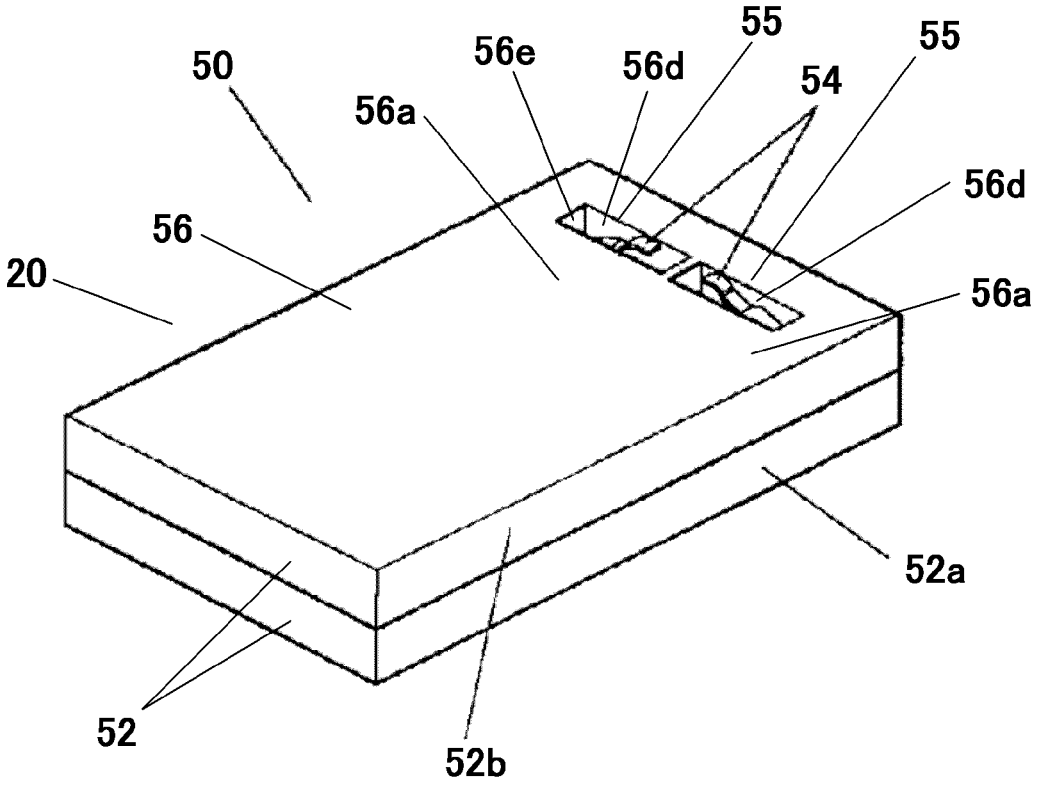
FIG. 15 is a perspective view of a fifth example of the sound reproducing device according to Embodiment 2.
Figure 16:
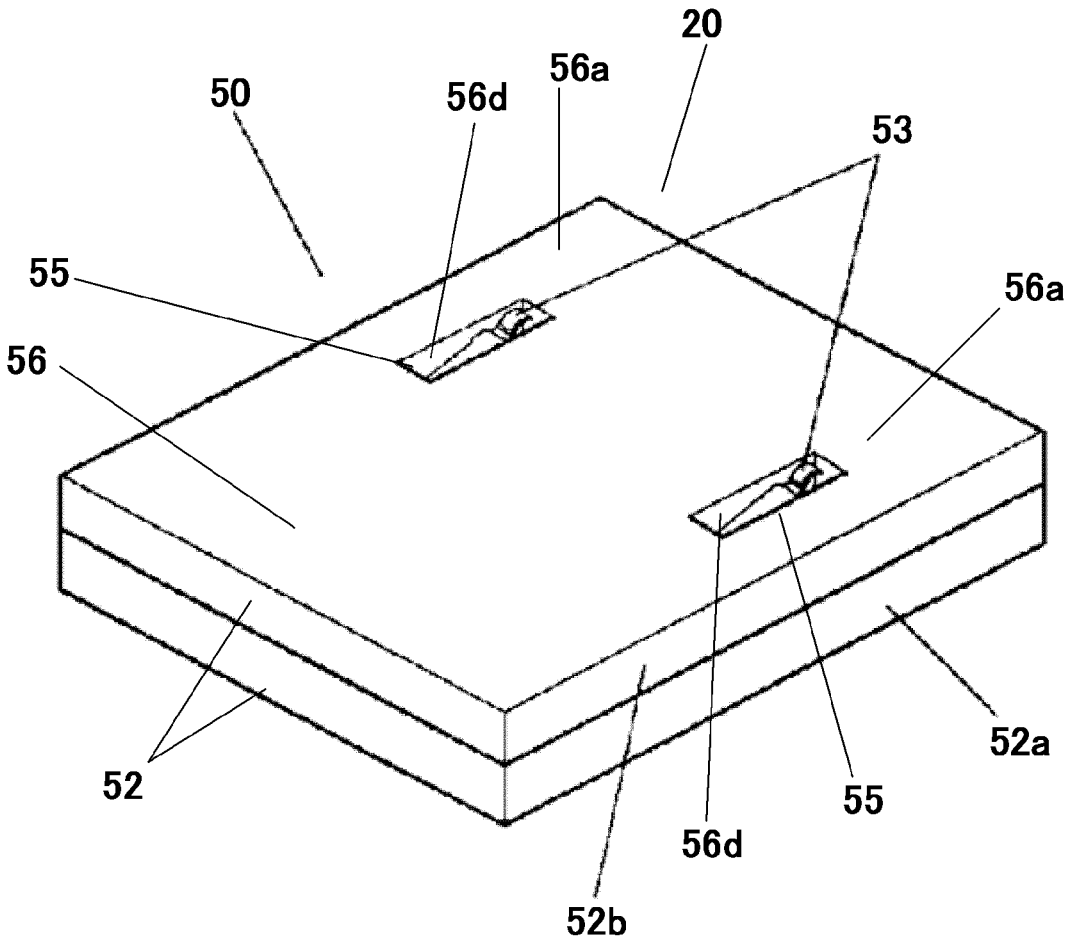
FIG. 16 is a perspective view of a sixth example of the sound reproducing device according to Embodiment 2.

FIG. 15 is a perspective view of a fifth example of the loudspeaker system according to this embodiment. As shown in FIG. 15, terminal 54 may be provided only at one end side. FIG. 16 is a perspective view of a sixth example of the loudspeaker system according to this embodiment. As shown in FIG. 16, terminal 54 may be positioned at the center with the same effect as that in the above example.

Figure 17:
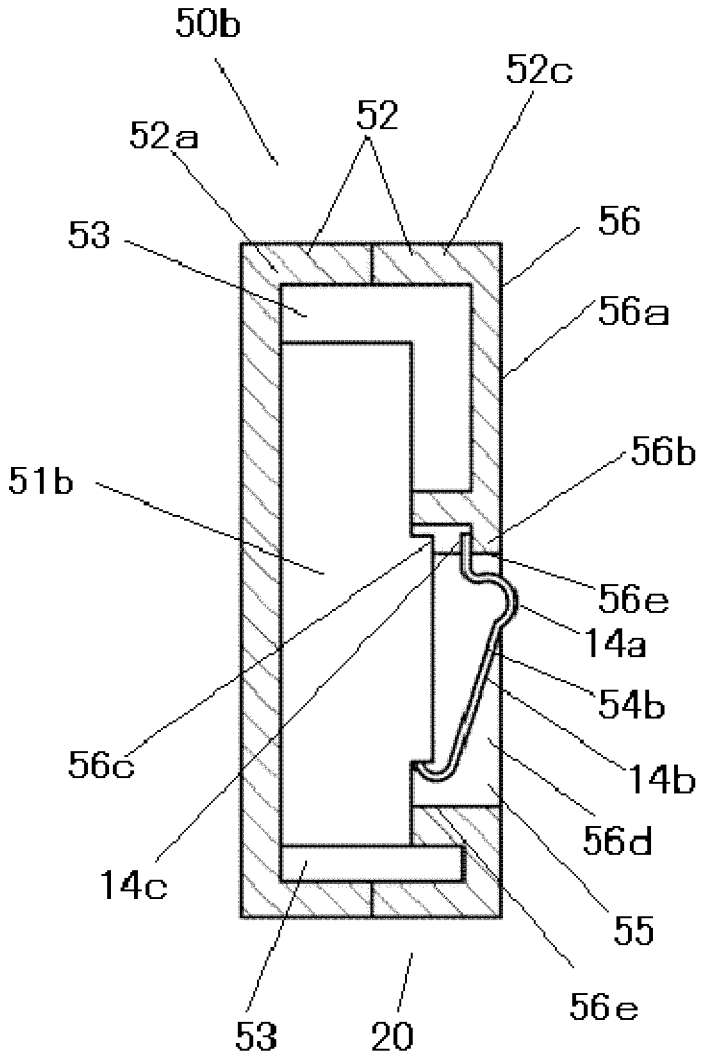
FIG. 17 is a cross-sectional view of a seventh example of the sound reproducing device according to Embodiment 2.

FIG. 17 is a perspective view of a seventh example of the loudspeaker system according to this embodiment. As shown in FIG. 17, terminal 54*b* of loudspeaker system 50*b* of this example has tip portion 14*c* at a tip thereof. However, terminal 54*b* does not have intermediate portion 14*b* between feeding portion 14*a* and tip portion 14*c*. Instead, tip portion 14*c* is directly provided at a tip of the feeding portion.

Tip portion 14*c* is configured to be caught by stopper 56*b*. Stopper 56*b* is formed on the inner bottom surface of back panel 52*b*. Terminal 54*b* is pressed to stopper 56*b* by the elastic force of terminal 54*b* in the back direction.

As described above, terminal 54 has tip portion 14*c* and protective portion 56 has stopper 56*b*. This structure can suppress plastic deformation of the terminal 114 in the back direction. This stabilizes the size of the portion of feeding portion 14*a* protruding from protective face 56*a*.

Furthermore, stopper 56 is formed at the bottom surface of loudspeaker unit 51*b*. Tip portion 14*c* faces stopper 56*c*. This configuration allows, when terminal 114 deforms in the elastic direction, tip portion 14*c* to contact stopper 56*c*, thereby preventing a further and excessive plastic deformation of terminal 114.

Exemplary Embodiment 3

Figure 18A:
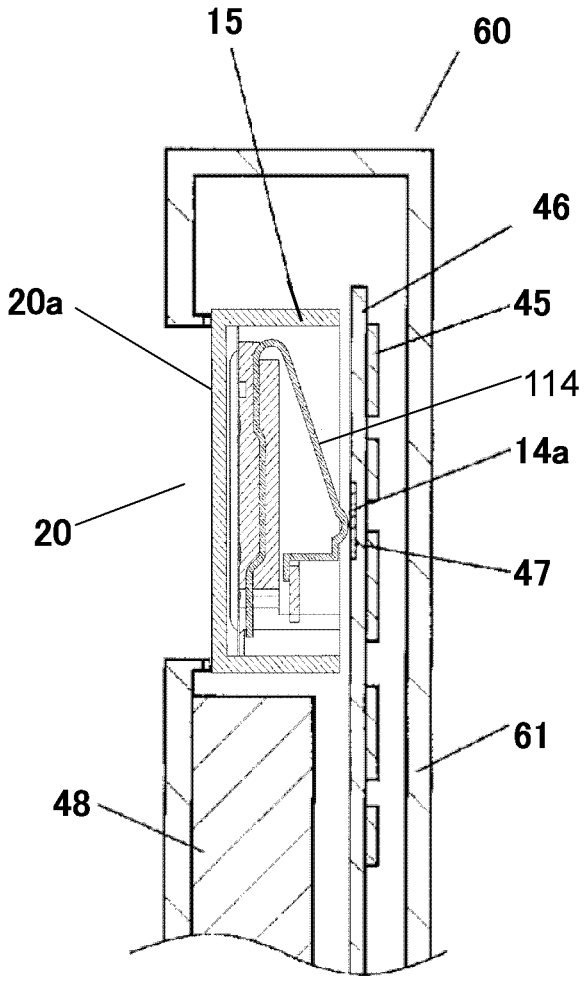
FIG. 18A is a cross-sectional view of a first example of a mobile device according to Exemplary Embodiment 3 of the present invention.
Figure 18B:
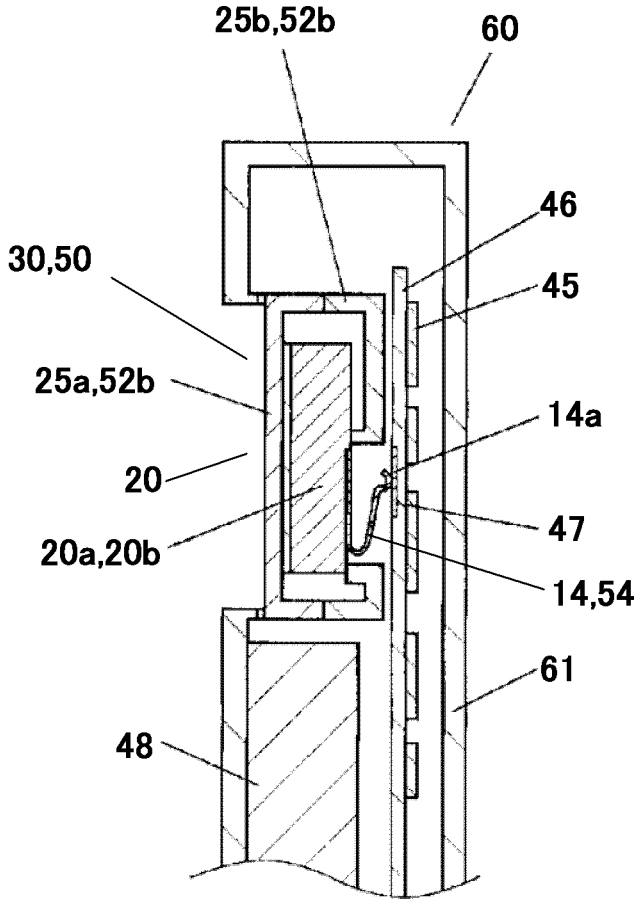
FIG. 18B is a cross-sectional view of a second example of the mobile device according to Embodiment 3.

An electronic device according to Exemplary Embodiment 3 will be described below with reference to the drawings. The electronic device according to this embodiment is mobile device 60, such as a mobile phone, a smart phone, a tablet terminal, a mobile game device, or a portable navigation. FIG. 18A is a cross-sectional view of the electronic device using loudspeaker unit 20*a* according to this embodiment. FIG. 18B is a cross-sectional view of a main part of the electronic device using loudspeaker system 30 or loudspeaker system 50 according to this embodiment.

As shown in FIGS. 18A and 18B, mobile device 60 is configured such that outer case 61 accommodates therein circuit board 46, electronic circuit 45 mounted onto circuit board 46, and a component, such as display device 48. Outer case 61 of mobile device 60 according to this embodiment accommodates therein sound reproducing device 20. Sound reproducing device 20 of this example may use loudspeaker unit 20*a* according to Embodiment 1, as shown in FIG. 18A. Alternatively, sound reproducing device 20 may use loudspeaker system 30 or loudspeaker system 50 according to Embodiment 2 as shown in FIG. 18B.

Circuit board 46 is placed at the back surface of sound reproducing device 20. Feeding portion 14 protruding from the back surface of sound reproducing device 20 is pressed by the elastic force of terminal 114 or terminal 54 to port 47 formed on circuit board 46. Feeding portion 14*a* contacting port 47 supplies an input signal to voice coil 12.

This configuration can prevent a worker working on an assembly step of mobile device 60 from erroneously touching terminal 114 or terminal 54. This can stabilize the contact between sound reproducing device 20 and port 47.

Since sound reproducing device 20 can have a small size, the electronic device, such as mobile device 60, can have a small thickness and a small size.

Furthermore, loudspeaker box 25 or loudspeaker box 52 having an air-tight structure can suppress the air leakage from loudspeaker box 25 or loudspeaker box 52. This can provide a desired sound pressure frequency characteristic even when the housing of mobile device 60 has poor airtightness, thus providing mobile device 60 having a high sound quality.

In this embodiment, loudspeaker unit 20*a*, loudspeaker system 30, or loudspeaker system 50 is mounted on a mobile device, but the present invention is not limited to this. The invention is applied to a stationary electronic device, such as a video device, e.g. television. Specifically, the invention can be applied to any electronic device including a loudspeaker system.

INDUSTRIAL APPLICABILITY

The present invention can be applied to an electronic device, such as a mobile device including a loudspeaker unit or a loudspeaker system required to have a smaller size, a small thickness, or a higher performance.

REFERENCE MARKS IN THE DRAWINGS

1 Loudspeaker System
2 Loudspeaker Unit
2*a* Terminal
3 Front Box
4*a* Back Plate
5 Terminal
6 Lead Wire
11 Yoke
12 Voice Coil
14*a* Feeding Portion
14*b* Intermediate Portion
14*c* Tip Portion
14*d* Fixing Portion
14*e* Connection Portion
15 Frame
15*a* Frame
15*b* Frame
16 Magnet
17 Plate
18 Diaphragm
19 Magnetic Circuit
20 Sound Reproducing Device
20*a* Loudspeaker Unit
20*b* Loudspeaker Unit
21 Protective Portion
21*a* Protective Surface
21*b* Stopper
21*c* Stopper
21*d* Protective Wall
21*e* Protective Wall
22 Restrained Portion
25 Loudspeaker Box
25*a* Front Panel
25*b* Back Panel
30 Loudspeaker System
31 Protective Portion
31*a* Protective Surface
31*b* Stopper
31*d* Protective Wall
31*e* Protective Wall
45 Electronic Circuit
46 Circuit Board
47 Port
50 Loudspeaker System
50*b* Loudspeaker System
51 Loudspeaker Unit
52 Loudspeaker Box
52*a* Front Panel
52*b* Back Panel
53 Space
54 Terminal
54*b* Terminal
55 Through-Hole
56 Protective Portion
56*a* Protective Surface
56*b* Stopper
56*c* Stopper
56*d* Protective Wall
56*e* Protective Wall
60 Mobile Device
61 Outer Case
114 Terminal

The invention claimed is:

1. A sound reproducing device comprising:

a magnetic circuit including a magnet, a yoke, and a plate;

a frame coupled to the magnetic circuit;

a diaphragm supported by the frame;

a voice coil fixed to the diaphragm; and a terminal having a base fixed to the frame and a tip portion, the terminal being coupled to the voice coil, the terminal being made of a wire spring or a plate spring; and a protective portion provided at a lower surface side of the sound reproducing device, the protective portion including a protective wall for restraining a deformation of the terminal in a direction different from an elastic deformation direction of the terminal, wherein the terminal includes a feeding portion to be fed and a restrained portion in which the deformation is restrained with the protective wall, the restrained portion is provided at at least one of a position between the base and the feeding portion of the terminal and a position between the tip portion of the terminal and the feeding portion, and wherein the protective wall extends along the restrained portion.

2. The sound reproducing device according to claim 1, wherein the protective wall is formed unitarily with the frame.

3. The sound reproducing device according to claim 1, wherein the terminal is made of the plate spring, and the protective wall covers a side surface of the terminal in a width direction except for a portion around the feeding portion.

4. The sound reproducing device according to claim 1, wherein the diaphragm is located in a front direction from the terminal and the terminal is located in a back direction from the diaphragm, wherein the tip portion of the terminal extends in a substantially horizontal direction, and wherein the protective portion includes a stopper for restraining the deformation of the terminal in the elastic deformation direction, and the stopper faces the tip portion of the terminal.

5. The sound reproducing device according to claim 4, wherein the stopper restrains the deflection of the terminal in the back direction, and the stopper is formed unitarily with the protective portion.

6. The sound reproducing device according to claim 4, wherein the stopper restrains the deflection of the terminal in the front direction and the stopper is formed unitarily with the frame.

7. The sound reproducing device according to claim 5, further comprising:

a loudspeaker box covering at least a back surface of the frame, wherein the stopper is formed unitarily with the loudspeaker box.

8. The sound reproducing device according to claim 1, further comprising a loudspeaker box covering at least a back surface of the frame, wherein the loudspeaker box has a through-hole formed therein at a position corresponding to the feeding portion.

9. The sound reproducing device according to claim 1, further comprising a loudspeaker box covering at least a back surface of the frame, wherein the protective wall is formed at the loudspeaker box.

10. The sound reproducing device according to claim 9, wherein the protective wall surrounds the terminal in three or four directions out of directions other than the elastic deformation direction of the terminal.

11. The sound reproducing device according to claim 10, wherein the protective wall surrounds the terminal in directions except for the elastic deformation direction of the terminal, and wherein an edge of the protective wall contacts a back surface of the frame.

12. The sound reproducing device according to claim 10, wherein the protective wall surrounds the terminal directions except for the elastic deformation direction of the terminal, and wherein an gap between and edge of the protective wall and a back surface of the frame is sealed.

13. An electronic device comprising:

the sound reproducing device according to claim 1;

an outer case accommodating the sound reproducing device therein;

a circuit board that is provided at a back surface of the sound reproducing device and that is provided in the outer case to contact a feeding portion of the terminal; and a circuit for supplying a signal to the sound reproducing device.

14. The electronic device according to claim 13, further comprises a display device, wherein the electronic device is a mobile device.

* * * * *